United States Patent [19]

Silverman

[11] Patent Number: 4,893,820

[45] Date of Patent: Jan. 16, 1990

[54] GAME APPARATUS AND METHOD

[76] Inventor: Andrew Silverman, 313 Thunder Circle, Bensalem, Pa. 19020

[21] Appl. No.: 91,899

[22] Filed: Sep. 1, 1987

[51] Int. Cl.[4] ..... A63F 3/00

[52] U.S. Cl. ..... 273/249; 273/290

[58] Field of Search ..... 273/248, 249, 250, 251, 273/252, 253, 254, 246, 244

[56] References Cited

U.S. PATENT DOCUMENTS

| | | | |
|---|---|---|---|
| 3,565,438 | 2/1971 | Bischof | 273/253 |
| 3,874,671 | 4/1975 | Smith | 273/254 |
| 4,434,984 | 3/1984 | Bergstrom | 273/246 |
| 4,703,934 | 11/1987 | Erb | 273/244 |

FOREIGN PATENT DOCUMENTS

| | | | |
|---|---|---|---|
| 2030875 | 4/1980 | United Kingdom | 273/254 |

*Primary Examiner*—Richard C. Pinkham
*Assistant Examiner*—Benjamin Layno
*Attorney, Agent, or Firm*—Steele, Gould & Fried

[57] ABSTRACT

A game apparatus comprising a playing board having a grid of interconnected segments depicting a plurality of selectable movement paths. Certain areas of the grid are differently colored. Each player has a position marker for movement along the paths towards the colored areas. The position markers are adapted to hold a set of progress markers. These progress markers are also differently colored to correspond with the colored areas. Upon arriving at a colored area, a player receives a correspondingly colored progress marker and places it on his/her position marker. A first chance device having movement direction indicia controls the direction of movement of the position marker. A second change device controls the magnitude of the movement. The game apparatus further comprises a third chance device bearing colors corresponding to the colors of the progress markers. According to the rules, players may capture opponent's progress markers by utilizing the third chance device.

5 Claims, 3 Drawing Sheets

GAME APPARATUS AND METHOD

BACKGROUND OF THE INVENTION

1. Field of the Invention

The invention relates to the field of competitive games suited for a plurality of players, and in particular, to a board game wherein progress is controlled in part by skillful and strategic management of a scarce resource, and in part by chance.

2. Statement of Art

The game apparatus and method taught herein share certain features with typical board games, yet are characterized by unique structural features and unique interrelationships between the unique features and those shared in common with other games. The playing board depicts a grid of interconnected segments defining a plurality of selectable player movement paths. In the presently preferred embodiment, a plurality of nodes or intersections presents each player with an opportunity to move in one of eight different directions. The scarce resource which must be managed for maximum benefit during the course of the game relates to the ability of each player to choose a direction of movement at each turn. The magnitude of movement in any chosen direction, at each turn, may be determined by a chance means, such as dice or a spinner. The collection of progress markers is related to accessing unique indicia disposed in different zones of the movement grid. The method is characterized by the loss and collection of movement direction markers, which is contingent at least in part upon frequent movement between the different zones, to access the indicia during the course of the game.

Certain patent references are known in which markers relating to changes of direction on a playing field are disclosed, for example U.S. Pat. No. 3,820,7911-Powers and U.S. Pat. No. 4,331,333-Willcocks, although none is similar in structure or use to those of this invention. Other games are known which utilize a playing grid having multi-directional paths, as embodied in a game manufactured and sold by the Warren Company, the copyright being in the name of Hasbro Industries and dated 1984, and entitled TRANSFORMERS. The Transformers game utilizes a playing grid having a repetitive hexagonal block pattern, wherein each segment connected to a node is provided with a number from 1 through 6. Operation of dice constrains a player to move along the corresponding identified segments. Accordingly, a player is able to move only one or two nodes away from a present position irrespective of the magnitude of the number shown on the dice; and, may not always be able to move in a desired direction. The object of the game is to rescue (i.e., collect) one each of six sets of robot/truck markers. In this game, which is intended for play by young children, the scarce resource amounts to a player's ability to move along the grid by rolling one die or two dice, depending upon the transformed state of the players position marker. The transformed state depends largely upon indicia on cards randomly drawn from a set of such cards. Although there may be deemed some similarity between the Transformer game and that taught herein, the similarity is superficial at most.

SUMMARY OF THE INVENTION

It is an object of this invention to provide a game apparatus and method enabling a plurality of players to compete with one another.

It is another object of this invention to provide a competitive game which enhances the player's knowledge of, and familiarity with vector movements.

It is yet another object of this invention to provide a competitive game, enabling players to develop skills managing a scarce resource.

It is yet another object of this invention to provide a competitive game, enabling players to develop strategic skills in coordinating player movements and resource management.

It is yet another object of this invention to provide a competitive game which is fun to play.

It is yet another object of this invention to provide a competitive game which can be embodied in a large number of specific formats.

These and other objects of the invention are accomplished by a game apparatus, comprising: a playing board having a grid of interconnected segments depicted thereon for defining a plurality of selectable player movement paths; a grid position marker for each player; a set of progress markers for each player, the progress markers of each set corresponding by unique and respective features to indicia on the movement grids; a set of movement direction markers, each defining at least one direction of movement on the grid, from which sets of movement direction markers can be accumulated by each player by random selection for subsequent use in repositioning each grid mark in turn; and, chance means for defining a magnitude movement for repositioning each grid mark in turn, whereby players may compete by moving respective position markers on the grid, coordinating the direction markers and the chance means, to collect progress markers. In the presently preferred embodiment, the movement direction markers may comprise a deck of cards having movement direction indicia printed on one side thereof. The grid position marker may preferably comprise means for holding a set of progress markers, whereby the relative competitive position of each player may be easily ascertained. The game apparatus may further comprise second chance means bearing indicia corresponding to the unique indicia of the progress markers, whereby progress markers may be forfeited and collected between respective players.

These and other objects are also accomplished by a method for competing as a player in a game, comprising the steps of: accumulating movement direction markers by random selection from a set of such markers, each player receiving an initial sub-set of said direction markers to and from which subsequent direction markers will be added and moved as play proceeds, each of the direction markers defining at least one direction movement on a grid, the grid having a plurality of interconnected segments defining a plurality of selectable player movement paths; successively moving a position marker on the grid, in turn, by: (1) selecting one of the direction markers from the sub-set to define the direction of movement; and, (2) operating a chance means to define a magnitude of movement in the selected direction; and, collecting a set of progress markers, the progress markers corresponding by unique and respective features to indicia on the grid, by successively moving the position marker to the unique indicia. In the presently preferred embodiment, the method further comprises the step of discarding each selected direction marker after each turn. The play can be made more complex, and accordingly more interesting, by the further steps of: forfeiting a movement direction marker whenever a position marker passes a first boundary between playing zones on the grid; and, collecting a movement direction marker whenever a position marker passes a second boundary between other playing zones on the grid, whereby placement of at least one of the unique indicia in at least two of the playing zones complicates management of the movement direction markers. The game may also be made more interesting by providing players with an opportunity to take progress markers directly from other players who have already collected such markers, rather than by movement on the playing grid, by utilizing a second chance means bearing indicia corresponding to the unique indicia of the progress markers.

The game may be embodied in a wide variety of formats or settings. Such settings might include, without limitation: movement through space, wherein the position markers are space ships, and unique indicia further correspond to planets, stars or a solar system; movement through a city, wherein the position markers correspond to vehicles and the progress markers correspond to parcels; movement over a number of countries, wherein the position markers correspond to airplanes and the unique indicia further correspond to cities or countries, or products; or any other of a wide variety of settings.

BRIEF DESCRIPTION OF THE DRAWINGS

There are shown in the drawings forms which are presently preferred; it being understood, however, that the invention is not limited to the precise arrangements and instrumentalities shown.

DETAILED DESCRIPTION OF THE PREFERRED EMBODIMENTS

Figure 1:
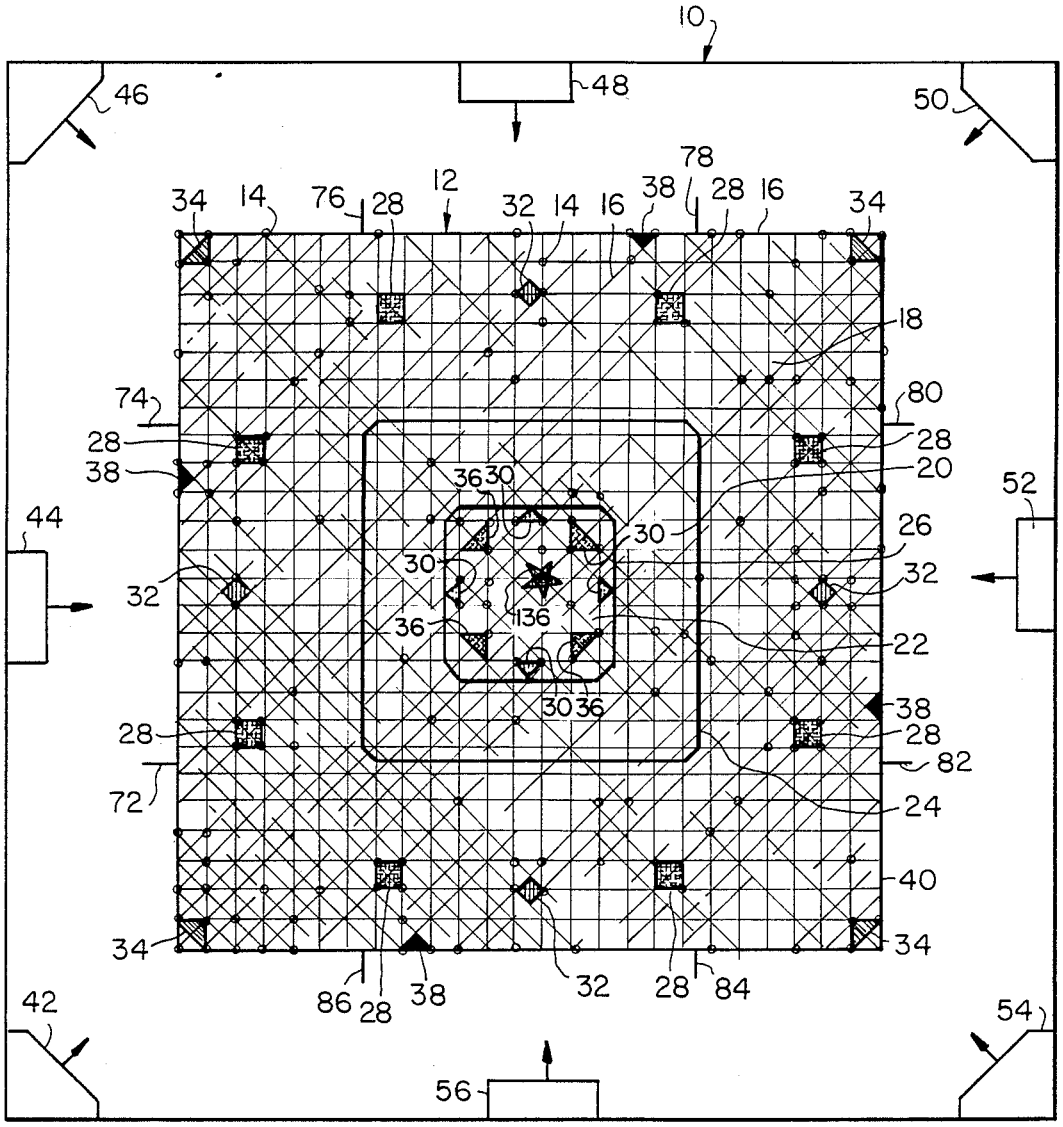
FIG. 1 is a top plan view of a playing board for this invention, having a segmented playing grid depicted thereon, the position of all unique indicia corresponding to progress markers being shown, but many of the segments being omitted for purposes of clarity.
Figure 2:
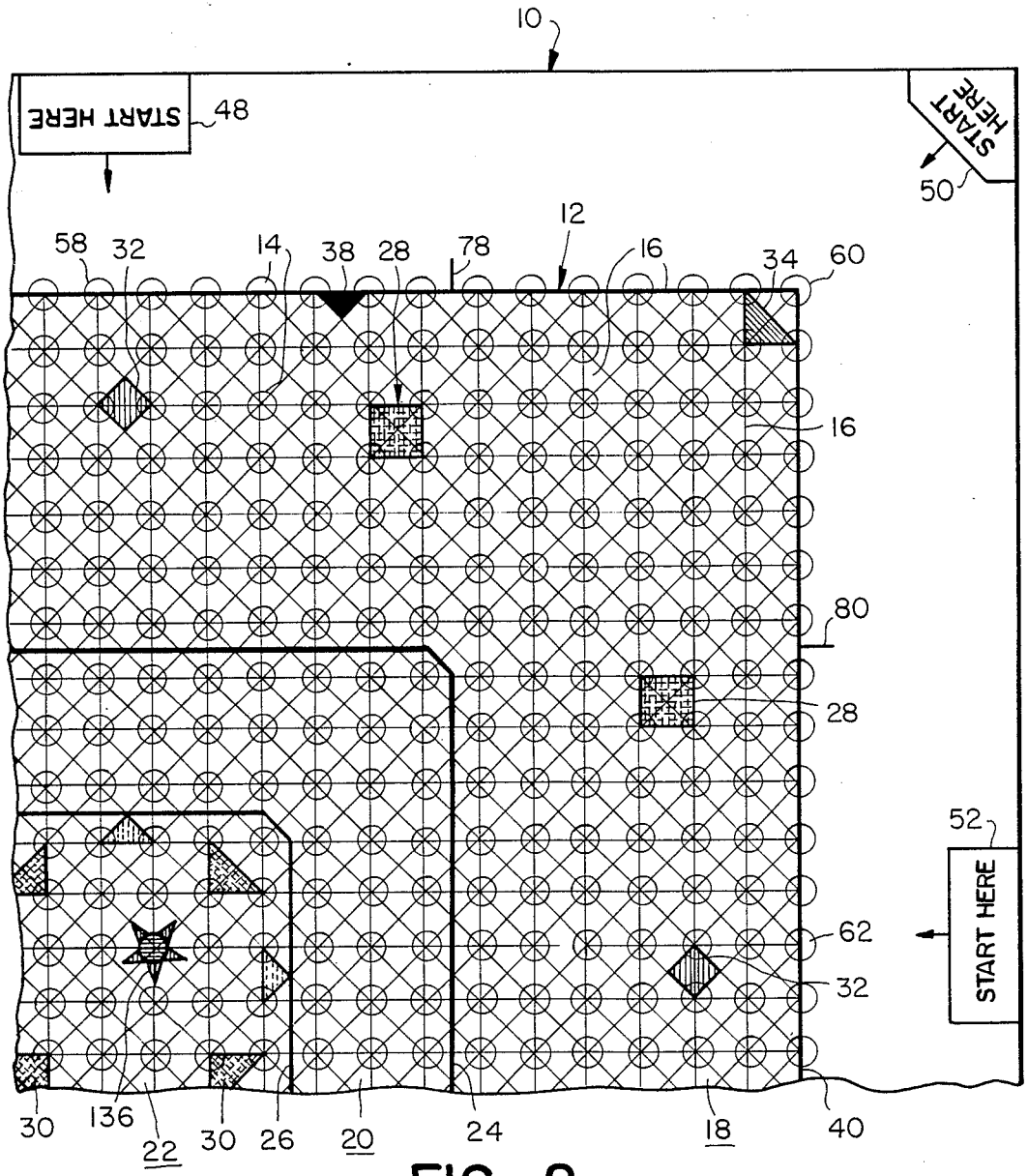
FIG. 2 is an enlarged view of slightly more than the upper right hand corner of the playing board shown in FIG. 1, the playing grid being otherwise substantially complete.

A game apparatus according to this invention comprises a playing board 10 as shown in FIGS. 1 and 2. FIG. 1 illustrates the entire playing board, which consists primarily of a movement grid 12. The movement grid comprises a plurality of nodes or intersections 14 joined by a plurality of segments 16. A substantial portion of the nodes 14 and segments 16 have been omitted from FIG. 1 for purposes of clarity. The upper right hand portion of FIG. 1 is shown in enlarged scale in FIG. 2, FIG. 2 including substantially all of the nodes or intersections 14 and segments 16. The nodes and segments define a plurality of selectable player movement paths.

The movement grid 12 is divided into a first or outer annular playing zone 18, a second or middle annular zone 20, and an inner zone 22. The boundary between the first and second zones 18 and 20 is marked by boundary line 24. The boundary between the second and third zones 20 and 22 is marked by boundary line 26. The playing grid 12 has depicted thereon a plurality of unique indicia, in the form of uniquely colored squares, diamonds and triangles. The choice of color as unique indicia is merely illustrative. There are a plurality of yellow indicia 28, orange indicia 30, red indicia 32, green indicia 34, blue indicia 36 and black indicia 38. At least some of the indicia are disposed in the first zone 18 and at least some of the indicia are disposed in the third zone 22. Players are accordingly forced to cross the first and second boundary lines 24 and 26 a plurality of times during the course of play in order to reach at least one of each of the unique indicia 28 through 38. In the presently preferred embodiment, none of the unique indicia are disposed in the middle zone 20, but some of the unique indicia may be so disposed in the middle zone 20, if desired.

Each playing board 10 also includes a plurality of starting blocks, which in the presently preferred embodiment, provide for up to eight players. Starting blocks 42, 44, 46, 48, 50, 52, 54 and 56 are disposed around the outer perimeter of the playing board 10, opposite and outside of the outer edge 40 of the movement grid 12. Each of the starting blocks includes indicia in the form of an arrow or the like, which points to a corresponding starting node along the outer edge 40. Three such starting nodes 58, 60 and 62 are illustrated in FIG. 2, and correspond respectively to starting blocks 48, 50 and 52 respectively. Hash marks 72, 74, 76, 78, 80, 82, 84 and 86 define home territories corresponding to each of the starting blocks 42 through 56. For example, the home territory for starting block 48 is defined between hash marks 76 and 78, whereas the home territory for starting block 50 is between hash marks 78 and 80. Chance means may be utilized as an alternative to determine the starting node for each player. The definition of such home territory may also be utilized in various alternative embodiments of playing the game.

The direction of movement for each player during the course of play is determined by a set of movement direction markers, each defining at least one direction of movement on the grid, from which sets of movement direction markers can be accumulated by each player by random selection for subsequent use. In the presently preferred embodiment, the set of movement direction markers are embodied in a set or deck of cards 88, each of which is provided with indicia 90 corresponding to one or more arrows defining at least one direction of permissible movement, or a legend. Each node or intersection 14 has eight segments 16 connected thereto, except for those nodes disposed along outer edge 40. Accordingly, the direction cards of set 88 include arrows enabling movement corresponding to one or more of each of the eight possible directions of movement which can be made at most, although not all of the nodes. In addition, certain legends may be utilized as instructions instead of arrows. For example, some of the cards may state: "REVERSE DIRECTION"; "MOVE IN ANY DIRECTION"; OR, "CHANGE SEATS WITH ANYONE". It will be appreciated that the various players perception of up, down, left, right, and the four diagonal directions will change depending upon a player's orientation. Changing one's position has the effect of rotating each of the direction cards which a player has collected. Alternatively, a relative sense of a forward direction can be defined by each playing piece, or position marker.

Figure 4:
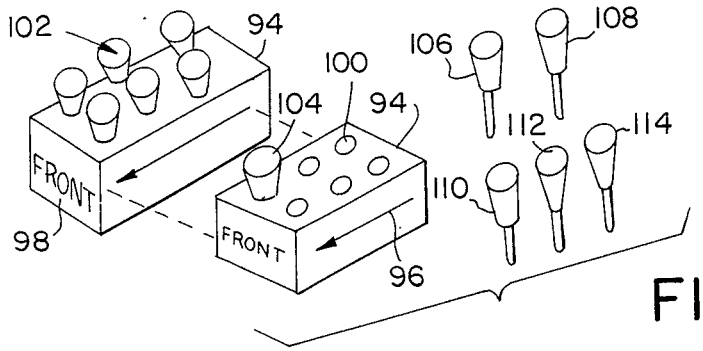
FIG. 4 illustrates position markers and sets of progress markers.
Figure 3:
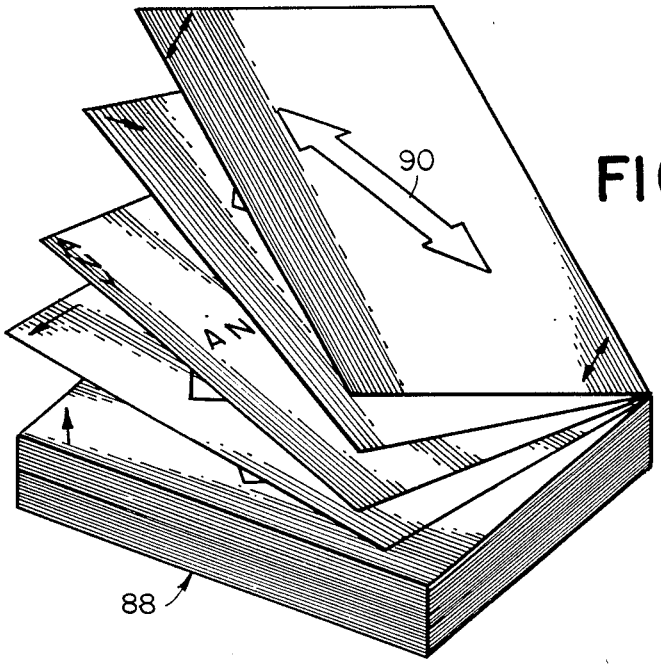
FIG. 3 illustrates a set of movement direction markers embodied as cards.

Typical grid position markers 94 are shown in FIG. 4. A grid position marker 94 is provided for each of the players. Depending upon the various formats in which the game may be embodied, the grid position markers might correspond to horses, rocket ships, airplanes, trucks, boats or any other form of typical transportation. Each of these embodiments will, by reason of its inherent design, shape or configuration, clearly define a front and rear. For purposes of illustrating a generic grid position marker, markers 94 are provided with indicia in the form of arrows 96 and legend 98 to clearly denote the front of each grid position marker. Each of the grid position markers 94 is provided with a plurality of holes 100, for accommodating complete sets 102 of progress markers. The progress markers are embodied in the illustrated embodiment as pegs having colors corresponding to the unique indicia 28 through 38 shown on the movement grid 12. Each set 102 of progress markers includes a yellow progress marker 104, an orange progress marker 106, a red progress marker 108, a green progress marker 110, a blue progress marker 112 and a black progress marker 114. A set of progress markers is provided for each of the players. The holes 100 and correspondingly dimensioned pegs of set 102 provide a means in each grid position marker for holding a set of progress markers, whereby the relative competitive position of each player may be easily ascertained during the course of play.

Figure 6A:
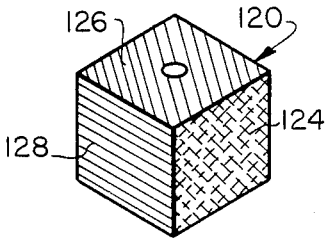
FIGS. 6*a* and 6*b* illustrate a die having six differently colored sides.
Figure 6B:
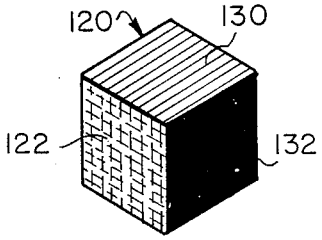
Figure 5:
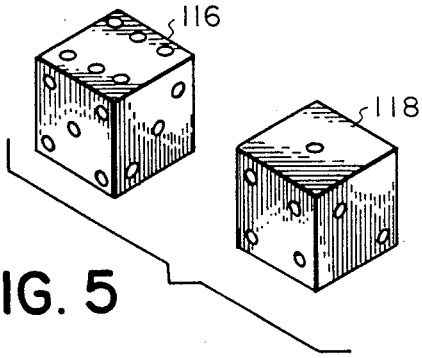
FIG. 5 illustrates a conventional pair of dice.

The magnitude of movement for repositioning each grid marker in turn is determined by a first chance means, shown in FIG. 5 as a typical pair of dice 116 and 118. A second chance means is an indicia die 120 shown in FIGS. 6*a* and 6*b*. In order to provide a means by which players may, under certain circumstances, seize one or more of the progress markers which have been collected by another player, each of the six faces of indicia die 120 corresponds to one of the unique indicia of the progress markers and of the corresponding unique indicia depicted on the movement grid. In the presently preferred embodiment, the unique indicia correspond to colors. Accordingly, each of the faces 122, 124, 126, 128, 130 and 132 of indicia die 120 correspond to one of the colors yellow, orange, red, green, blue and black.

The only special indicia depicted on the movement grid 12 and not yet described, is center or finish star 136. In the presently preferred embodiment, finish star 136 represents that specific node which each player must land on, by exact count, after collecting a complete set of progress markers.

The game apparatus as described above can be utilized to practice a method for competing as a player in a game, according to a general or generic set of rules. The following set of rules correspond to an embodiment of the game set in the context of six differently colored parcels which must be collected by each player, each player having a grid position marker in the form of a motor vehicle. Each of the motor vehicles is provided with means for holding one each of the six differently colored parcels. The object of the game is for a player to collect all six of the differently colored parcels and return to the center star 136 first. At the beginning of play, each player is provided with a grid position marker 94 in the form of a truck and three movement direction cards. Each player starts at a respective starting block, one of 42 through 52. The numbered dice 116 and 118 may be rolled to determine which player goes first, play proceeding clockwise thereafter. For purposes of these generic instructions, starting nodes for each of the starting blocks are also specified in the design of the grid on the playing board.

The grid position markers 94 must always move in a forward direction. The movement direction cards are used only to change direction, and may be used only prior to each player rolling the numbered dice. Each of the dice 116 and 118 is treated individually. Before a player rolls the numbered dice, the player may choose a movement direction card and thereafter may roll a five, two (5, 2). The player may move five spaces and then two spaces in the chosen direction; or, the player may move two spaces, change direction in accordance with the card, and then move five spaces in the new direction. Each space corresponds to one of the segments 16, connecting two nodes or intersections 14. Alternatively, the player might move two spaces in the first direction, change directions, and then move five spaces in the second direction. Movement is in the nature of a vector, including both direction of movement and magnitude of movement. Once a player has used a movement direction card, it is placed in a discard pile.

The management of the movement direction cards is complicated by the use of boundary lines 24 and 26 to divide the movement grid 12 into the first, second and third zones 18, 20, and 22. Each time a player's grid position marker crosses the first boundary line 24, that player may select another movement direction card from the deck 88. If a player is able to cross boundary line 24 twice in the same move that player can take two additional movement direction cards. This may be accomplished by cutting across a corner of the second zone 20 or by using an existing movement direction card to cross over and back. Moreover, each time a player is successfully in collecting a parcel, that player may select a movement direction card.

On the other hand, each time a player's grid position marker crosses the second boundary line 26, that player must forfeit a movement direction card. If a player crosses both boundary lines in the same move the player must select and forfeit movement direction cards, respectively, the order depending upon which boundary line was crossed first and which boundary line was crossed second.

Each player must collect one of each differently colored parcel, must collect such parcels in a predetermined order, and must thereafter land on the center or finish star before any other player does so. In the presently preferred embodiment, the parcels are to be picked up in the following order: yellow, orange, red, green, blue and black. In order for a player to collect a parcel, that player must conclude a move, with either die, directly on one of the nodes or intersections 14 forming a corner of the geometrical pattern of the unique indicia. For example, with reference to the upper right hand corner of the movement grid 12 as shown in FIG. 2, unique indicia 34 is a green triangle which can be accessed by landing on any one of three nodes or intersections 14. Moving to the left along outer edge 40, indicia 38 is a black triangle, smaller than the green triangle 34, and formed in such a way as to be accessed only by landing on one of two nodes or intersections 14. Moving downwardly somewhat, and slightly to the right, indicia 28 is a yellow square which can be accessed by any one of four nodes or intersections 14. This can be contrasted with the square or diamond-shaped indicia 32, at the lower right hand corner of grid 12 shown in FIG. 2, which is so oriented as to be accessed only by two nodes or intersections 14. The center star, which is not technically in the precise center of the movement grid, can be accessed only by landing on one node or intersection 14.

If, for example, a player is two spaces away from an indicia, and rolls two, four (2, 4) the player may move two spaces, collect the parcel, collect an additional movement direction card, and then move four additional spaces.

If a player is traveling in a certain direction, and is unable to change that direction, that player eventually will travel off of the movement grid 12 entirely. This is more likely when players try to access the indicia on or near outer boundary 40. Any such player must risk a penalty by rolling the indicia die 120, and forfeiting whichever parcel corresponds to the unique indicia indicated by the die. It will be appreciated that players having few or no parcels are at less risk than players having many or all parcels. Players leaving the movement grid entirely must return to one of the starting blocks, the determination of which starting block being made by means of the hash marks 72 through 86. Players are then required to collect a parcel of the very same color which was lost before picking up any additional parcels, in order to follow the basic rule of picking up the parcels in a predetermined order. It will also be appreciated that proper placement of the indicia in two or more of the playing zones will substantially increase the complexity of play, and substantially increase the difficulty of managing the collection of movement direction cards, as the number of times players must cross the boundary lines 24 and 26 can be maximized.

Occasionally, a player may land on a node or intersection 14 which is already occupied by another player. Whenever this occurs, the second player landing on the node or intersection 14 may roll the indicia die 120 and seize a parcel from the first player corresponding to the unique indicia shown on the die. If the second player already has that particular parcel the first player simply forfeits the parcel and must collect that parcel again. If the first player does not have the indicated parcel, the first player loses nothing. This procedure provides an interesting offensive opportunity for each of the players.

Players rolling doubles on the numbered dice are preferably afforded the choice of proceding in the normal fashion; or, selecting two additional movement direction cards, and rolling the dice again. After a player has retrieved all six differently colored parcels, that player must proceed to, and land on the center or finish star by exact count as the result of rolling both dice, not merely one of the dice. Even after a player has collected all six parcels in a set, it may be necessary to cross the first boundary line many times in order to accumulate sufficient movement direction cards to successfully land on the center or finish star 136.

It will be appreciated by those skilled in the art that the foregoing directions are appropriate not only for the collection of parcels, but are appropriate for a wide variety of game formats and contexts such as described above, and many others as well.

The invention may be embodied in other specific forms without departing from the spirit or essential attributes thereof. Accordingly, reference should be made to the appended claims, rather than to the foregoing specification, as indicating the scope of the invention.

What is claimed is

1. A game apparatus, comprising:

a playing board having a grid of interconnected segments depicted thereon for defining a plurality of selectable player movement paths, said grid further having unique indicia thereon;

a grid position marker for each plyaer;

a set of progress markers for each player, the progress markers of each set corresponding by unique and respective features to indicia on the movement grid;

a plurality of movement direction markers, each defining at least one direction of movement on the grid, from which sets of movement direction markers can be accumulated by each player by random selection for subsequent use in repositioning each grid marker in turn;

first chance means for defining a magnitude of movement for repositioning each grid marker in turn, whereby players may coordinate the direction markers and the first chance means to move respective position markers on the grid and collect progress markers; and, second chance means bearing indicia corresponding to the unique indicia of the progress markers, whereby progress markers may be forfeited and collected between respective players.

2. The game apparatus of claim 1, wherein the grid position markers comprise means for holding a set of progress markers, whereby the relative competitive position of each player may be easily ascertained.

3. The game apparatus of claim 1, wherein the movement direction markers comprise a deck of cards having movement direction indicia printed on one side thereof.

4. The game apparatus of claim 2, wherein the movement direction markers comprise a deck of cards having movement direction indicia printed on one side thereof.

5. A method for competing as a player in a game, of the kind played on a grid having a plurality of interconnected segments defining a plurality of selectable player movement paths, comprising the steps of:

accumulating movement direction markers by random selection from a set of such markers, each player receiving an initial subset of said direction markers to and from which subsequent direction markers will be added and removed as play proceeds, each of the direction markers defining at least one direction of movement of the grid;

successively moving a position marker on the grid, in turn by:

selecting one of the direction markers from the subset to define the direction of movement; and, operating a first chance means to define a magnitude of movement in the selected direction;

collecting a set of progress markers, the progress markers corresponding by unique and respectve features to indicia on the grid, by successively moving the position marker to the unique indicia; and, selectively collecting progress markers from another player by operating a second chance means bearing indicia corresponding to the unique indicia of the progress markers.

* * * * *